United States Patent [19]

Jones

[11] 4,014,723

[45] Mar. 29, 1977

[54] COMPOSITE CONTAINERS

[75] Inventor: Ulpian Robin Edward Frost Jones, St. Albans, England

[73] Assignee: The Metal Box Company Limited, Reading, England

[22] Filed: Mar. 30, 1972

[21] Appl. No.: 239,564

[30] Foreign Application Priority Data

Apr. 14, 1971 United Kingdom ..... 9377/71

[52] U.S. Cl. ..... 156/69; 53/35; 215/233; 220/66; 427/240

[51] Int. Cl.[2] ..... B29C 27/00

[58] Field of Search ..... 156/69; 229/5.5; 117/101; 53/35; 220/66; 215/80

[56] References Cited

UNITED STATES PATENTS

| | | | |
|---|---|---|---|
| 2,383,230 | 8/1945 | Voke | 156/69 |
| 2,584,095 | 1/1952 | Slaughter | 156/69 X |
| 3,556,383 | 1/1971 | Glashand et al. | 229/5.5 |
| 3,563,791 | 5/1969 | Janco | 117/101 X |

*Primary Examiner*—Edward G. Whitby
*Attorney, Agent, or Firm*—Diller, Brown, Ramik & Wight

[57] ABSTRACT

A container which comprises a tubular body made of paperboard or of a laminate including paper has its ends closed by closure members made of a different material such as tinplate or a plastics material. Each closure member includes a plug portion which closely engages an end part of the body and a rim which extends laterally from the plug portion and is disposed to be closely adjacent to the end face of the body. At at least one end of the body the closure member therefor is at least in part secured to the body by a continuous band of thermoplastics material which extends lengthwise of the plug portion and forms at the inner end of the plug portion a bead arranged to caulk the leak path between the body and the plug portion to the rim.

3 Claims, 3 Drawing Figures

COMPOSITE CONTAINERS

BACKGROUND OF THE INVENTION

1. Field of the Invention

This invention relates to containers and in particular to a container of the kind known as a composite, that is a container which comprises a tubular body made of paperboard or of a laminate including paper, and end closure members which are usually made of a different material such as thin sheet metal, for example tinplate, or a plastics material, and each of which includes a plug portion which closely engages a part of the body at an end thereof and a rim which extends laterally from the plug portion and is disposed to be closely adjacent to the end face of the body. Such a container will be referred to below and in the appended claims as a container of the kind described.

2. Description of the Prior Art

Heretofore it has been usual for an end closure member to be secured to the body by a flange formed in extension of the plug portion which fits in an end of the body, the flange being bent around the end of the body and crimped against the outside of the body.

It is a main object of the present invention to so construct a container of the kind described as to reduce the amount of moisture, gas, odour, or liquid transmission into the container through the end closure members, and to increase the strength of attachement of the end closure members to the body.

SUMMARY

According to the invention there is provided a container of the kind described wherein at least one end of the body is closed by an end closure member which is at least in part secured to the body by a continuous band of thermoplastics material which extends lengthwise of the plug portion of the end closure member and which forms at the inner end of the plug portion a bead arranged to caulk the leak path between the body and plug portion to the rim adjacent to the end face of the body.

According to another aspect the invention contemplates the method of making a container of the kind described which includes the steps of pressing the plug portion of a closure member axially of the body against a continuous band of softened thermoplastics material initially spaced from an end face of the body thereby to smear the thermoplastics material along the body and to form a bead of the thermoplastics material at the inner end of the plug portion, and cooling the thermosplastics material to create a bond between the plug portion and the body.

DESCRIPTION OF THE PREFERRED EMBODIMENTS

Figure 1:
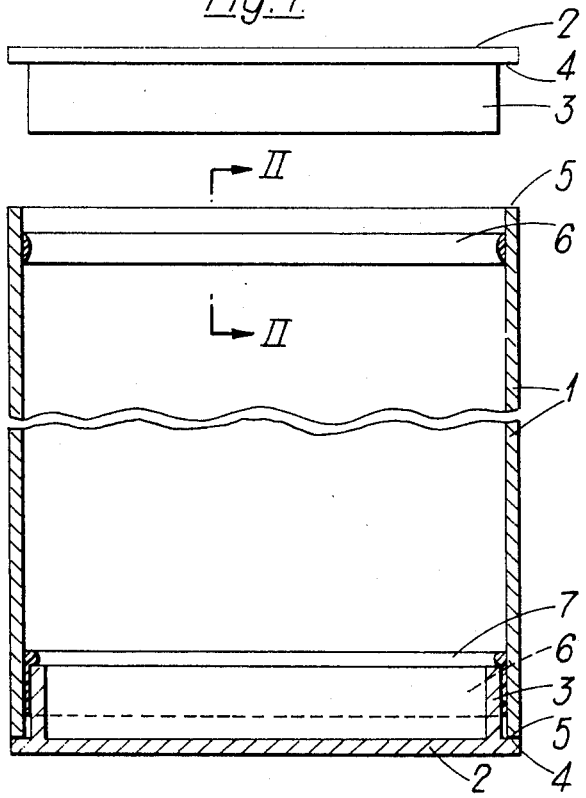
FIG. 1 illustrates, partly in section, a container according to the invention.
Figure 2:
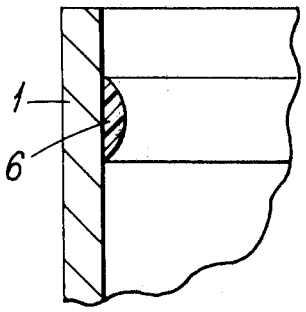
FIG. 2 is a section, to an enlarged scale, on line II—II, FIG. 1.

Referring to FIGS. 1 and 2, the container comprises a tubular body 1 made of paperboard or of a laminate including paper and two end closure members 2 each of which includes a plug portion 3, which may be annular as illustrated or which may be solid, and a rim 4 which latter is closely adjacent to or abuts the end face 5 of the body when assembled therewith as illustrated at the lower end of FIG. 1. Usually the body 1 will be spirally or convolutely wound in known manner. Each end closure member when assemblied with the body is secured to the body by a continuous band of hot melt material 6 based on polymeric materials, for example waxy compositions based on ethyl vinyl acetate copolymers, or polymers and copolymers of polyamide resins, which is spaced from the end face 5 of the body 1 and the rim 4 of the closure members 2, which extends lengthwise of the plug portion 3, and which forms at the inner end of the plug portion 3 a bead 7 arranged to caulk the leak path between the body 1 and the plug portion 3. The caulking of the leak path as just described prevents wicking of the contents of the container into the end fibres of the body material at the end face 5 of the body and reduces the amount of moisture, gas, odour, or liquid transmission into the container through the end closure members. The end closure members 2 may be made of thin sheet metal, for example tinplate, from plastics meterials, or from paperboard or any other suitable material.

As illustrated in the drawings the plug portion 3 is a friction fit in the body 1.

Figure 3:
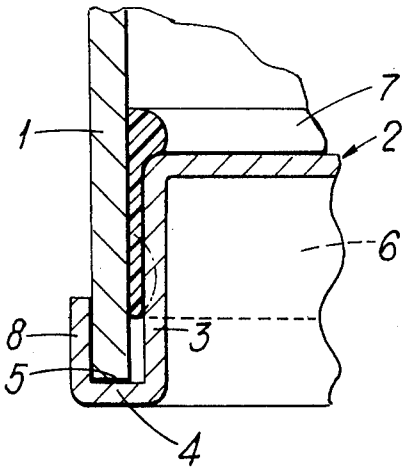
FIG. 3 is a section illustrating an alternative embodiment of the container.

FIG. 3 illustrates an alternative embodiment of the invention in which the end closure is preferably made of thin sheet metal and includes a skirt portion 8 which engages the exterior of the body 1. Should the container be stood on the filling table of the filling machine for filling with a liquid, the skirt 8 provides protection against seepage of the liquid into the end fibres of the body material should some liquid be spilled on to the table.

The thermoplastics material is applied to the body 1 in a softened state, in any suitable known manner, for example by directing a jet of softened thermoplastics material on to the body during relative rotation between the jet and the body in a manner such that the thermoplastics material is spaced from the end face 5 of the body and the plug portion 3 of the end closure member is then pressed into the body. The action of pressing the plug portion 3 into the body causes some of the soft thermoplastics material to be smeared along the inside of the body and form the bead 7 which caulks the leak path as described above. On cooling of the assembly the closure member is firmly bonded to the body.

It will be understood that the container will usually be supplied with only one end closure member bonded thereto, the other end closure member being assembled with the body and bonded thereto following the filling of the container with the product it is to contain.

When the container is supplied with only one end closed the opposite end may have the thermoplastics material applied thereto, as described above, but solidified for storage and transport. Then, following insertion of the contents into the container the solidified thermoplastics material at the open end of the container may be softened by the application of heat thereto, for example by applying heated air to the thermoplastics material, and when the material is softened sufficiently the plug portion of an end closure member is pressed into the body in the manner described above.

Although in the foregoing both ends of the container have been described as being closed by an end closure member secured in position by a band of thermosplastics material 6, it is to be understood that, if desired, only one end of the body 1, usually the bottom end, may be so closed, the other, or top, end being closed by any suitable known kind of end closure, for example a conventional seamed-on end closure.

It is found that in most instances the end closure members are sufficiently secured to the body when bonded thereto as described above but if it is desired to obtain an even greater degree of securing the end closure members may be further secured by the use of crimped-over flanges such as have hitherto formed the sole means of securing the end closure members to bodies.

In the foregoing description it has been assumed that the container is of circular cross-section, but it is to be understood that the cross-section may be other than circular, for example it may be oval or rectangular.

I claim:

1. The method of making a container of the type including an open ended tubular body and a closure member having a plug portion receivable in one end of said body, said method including the steps of applying a thick continuous band of softened thermoplastics material to the interior of the body at a position spaced from an adjacent end face of the body, smearing the thermoplastics material along the interior of the body by pressing the plug portion of the closure member axially of the body into closing relation with the body and with concomitant formation at the inner end of the plug portion of a bead of the thermoplastics material to caulk the leak path between the body and the plug portion to the rim adjacent to the end face of the body, and cooling the thermoplastics material to create a bond between the plug portion and the body, the thermoplastics material being applied to the body in a molten state immediately prior to the application of the end closure member to the body with the thermoplastics material being applied in the form of a jet during relative rotation between the jet and body.

2. The method according to claim 1 in which a continuous band of softened thermoplastics material is applied to the interior of the opposite end of the body and is solidified for storage and transport of the container.

3. The method according to claim 2 including the steps of filling the container, softening the solidified thermoplastics material, and pressing the plug portion of an end closure member axially of the body against the softened thermoplastics material thereby to smear the thermoplastics material along the body and to form a bead of the thermoplastics material at the inner end of the plug portion, and cooling the thermoplastics material to create a bond between the plug portion and the body.

* * * * *